US009816357B2

(12) United States Patent
Abraham

(10) Patent No.: US 9,816,357 B2
(45) Date of Patent: Nov. 14, 2017

(54) METHOD AND SYSTEM TO AVOID PREMATURE ACTIVATION OF LINER HANGER

(71) Applicant: Schlumberger Technology Corporation, Sugar Land, TX (US)

(72) Inventor: Aju Abraham, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 872 days.

(21) Appl. No.: 14/050,972

(22) Filed: Oct. 10, 2013

(65) Prior Publication Data

US 2015/0101827 A1 Apr. 16, 2015

(51) Int. Cl.
*E21B 43/10* (2006.01)
*E21B 23/01* (2006.01)

(52) U.S. Cl.
CPC ..... *E21B 43/10* (2013.01); *E21B 23/01* (2013.01)

(58) Field of Classification Search
CPC ..... E21B 43/10; E21B 23/00; E21B 23/04; E21B 23/06; E21B 23/01; E21B 33/1272; E21B 33/1295
USPC ..... 166/208, 212, 120, 382
See application file for complete search history.

(56) References Cited

U.S. PATENT DOCUMENTS 3,291,220 A * 12/1966 Mott ..... E21B 23/04 166/208
4,249,601 A 2/1981 White
5,553,672 A 9/1996 Smith et al.
6,138,761 A * 10/2000 Freeman ..... E21B 33/124 166/207
6,681,860 B1 * 1/2004 Yokley ..... E21B 23/01 166/208
7,373,988 B2 5/2008 Campbell et al.
8,074,718 B2 12/2011 Roberts
8,439,113 B2 5/2013 Boyle
2003/0098164 A1 * 5/2003 Hirth ..... E21B 43/10 166/382
2005/0006106 A1 * 1/2005 Hirth ..... E21B 43/10 166/382
2007/0007014 A1 1/2007 Sessions et al.
2010/0243277 A1 9/2010 Ring et al.
2011/0247832 A1 10/2011 Harris
(Continued)

OTHER PUBLICATIONS

International Search Report and Written Opinion issued in PCT/US2014/059991 on Jan. 23, 2015, 10 pages.

*Primary Examiner* — David Andrews
*Assistant Examiner* — Ronald Runyan
(74) *Attorney, Agent, or Firm* — Jeffery R. Peterson

(57) ABSTRACT

A technique facilitates avoidance of premature actuation of a liner hanger in a wellbore. The technique utilizes a running string which may be coupled to a liner having a liner hanger. The running string extends into the liner in a manner which creates an inner pressure region within the running string, an intermediate pressure region between the running string and the liner, and an outer or annulus pressure region surrounding the liner. The inner pressure region is initially isolated from the intermediate pressure region by a closure mechanism during, for example, movement downhole. The closure mechanism selectively closes off a port used to actuate the liner hanger.

17 Claims, 2 Drawing Sheets

(56) References Cited

U.S. PATENT DOCUMENTS

2012/0018172 A1 1/2012 Javed
2012/0285703 A1* 11/2012 Abraham ..... E21B 17/06
166/382

* cited by examiner

METHOD AND SYSTEM TO AVOID PREMATURE ACTIVATION OF LINER HANGER

BACKGROUND

A liner hanger is used to hang a liner within host casing. A liner is a tubular, e.g. a casing, which joins the host casing at a downhole location. The host casing may extend upwardly to a surface location. Generally, liner hangers are either mechanically or hydraulically actuated. For example, hydraulic liner hangers may be hydraulically actuated by shearing pins or rings having a predetermined shear value. However, pressure spikes can occur while running the liner hanger downhole through the wellbore. These pressure spikes can prematurely cause actuation of the liner hanger.

SUMMARY

In general, a methodology and system are provided for avoiding premature actuation of a liner hanger in a wellbore. A running string is coupled to a liner having a liner hanger. The running string extends into the liner in a manner which creates an inner pressure region within the running string, an intermediate pressure region between the running string and the liner, and an outer or annulus pressure region outside the liner. The intermediate pressure region and the annulus pressure region may be pressure balanced during movement downhole into the wellbore if the annulus pressure region increases in pressure to a level above the pressure level in the intermediate pressure region. The inner pressure region is initially isolated from the intermediate pressure region by a closure mechanism during, for example, movement downhole. The closure mechanism closes off a port used to actuate the liner hanger, and the port may be selectively opened when actuation of the liner hanger is desired.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate deployment of a liner hanger, e.g. a hydraulically actuated liner hanger. The technique protects the liner hanger from pressure spikes which could otherwise prematurely actuate the liner hanger prior to placement of the liner and liner hanger at a desired location in the wellbore. The liner hanger is isolated from such pressure spikes until the liner reaches a desired depth and is ready to be set.

According to an embodiment, the system and methodology employ a running string coupled to a liner having a liner hanger. The running string extends into the liner and has an internal pressure region which is isolated during deployment of the liner downhole via the running string. Additionally, an intermediate pressure region is created between the running string and the liner, and an annulus pressure region is located external to the liner. The intermediate pressure region and the annulus pressure region may be pressure balanced during movement downhole into the wellbore if the annulus pressure rises above the intermediate pressure. The inner pressure region is initially isolated from the intermediate pressure region by a closure mechanism, such as a sliding sleeve joint. The closure mechanism closes off a port used to actuate the liner hanger, and the port may be selectively opened when actuation of the liner hanger is desired.

In some applications, the liner hanger is part of a bottom hole assembly and comprises a liner top packer with a setting mechanism, such as a setting sleeve. The bottom hole assembly also may comprise the liner and the liner hanger, e.g. a hydraulic liner hanger. Depending on the application, the liner hanger bottom hole assembly may comprise additional and/or other components. Similarly, the running string may comprise a variety of components, such as a packer setting tool, a liner running tool, an upper pack off, a closure mechanism, e.g. sliding sleeve joint, a lower pack off, and an integral sealing seat, such as a ball seat.

Figure 1:
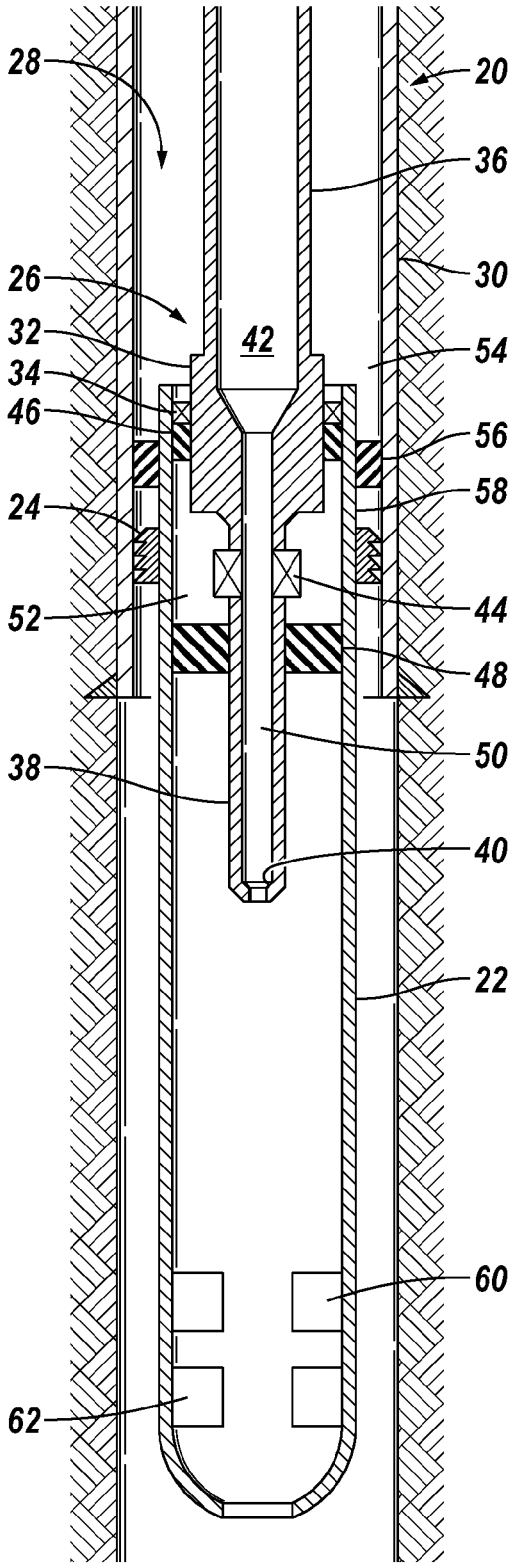
FIG. 1 is a schematic illustration of an example of a liner and liner hanger deployed downhole into a wellbore by a running string, according to an embodiment of the disclosure.

Referring generally to FIG. 1, an embodiment of a well system 20 is illustrated as comprising a liner 22 having a liner hanger 24 forming a liner hanger bottom hole assembly. The liner 22 is combined with a running string 26 which delivers the liner 22 and liner hanger 24 downhole into a wellbore 28. In this example, the liner 22, liner hanger 24, and running string 26 are deployed down into wellbore 28 through a casing 30, e.g. a host casing. The running string 26 extends into the liner 22 and is engaged with the liner 22 via a running tool 32 having a coupling mechanism 34 by which the running tool 22 is engaged with liner 22. The coupling mechanism 34 may be designed to mechanically engage, frictionally engage, or otherwise engage an interior of the liner 22. The running string 26 may further comprise a tubing 36, such as a drill pipe, coupled with the running tool 32 for deploying the liner 22 downhole.

The running string 26 also may comprise a tail pipe 38 extending from running tool 22 on an opposite side of running tool 32 relative to tubing 36. In the example illustrated, the tailpipe 38 comprises a seat 40 designed and oriented to sealingly receive a dropped object. For example, the seat 40 may comprise a ball seat against which a dropped ball may seal when dropped down through an interior 42 of running string 26. The running string 26 also may comprise a closure mechanism 44 which may be selectively actuated to enable passage of pressurized fluid, e.g. pressurized hydraulic fluid, for actuating liner hanger 24. In the embodiment illustrated, the system utilizes a first pack off 46, such as an upper pack off, and a second pack off 48, such as a lower pack off. By way of example, the first and second pack offs 46, 48 may be seals positioned between liner 22 and the running string 26. In some applications, the lower pack off 48 may be a drillable or retrievable type of pack off.

The pack offs 46, 48 establish pressure regions, such as an inner pressure region 50, an intermediate pressure region 52, and an outer or annulus pressure region 54. In this example, the inner pressure region 50 is located at least in part within running string 26. Intermediate pressure region 52 is located between the running string 26 and the liner 22 within the region bounded by first pack off 46 and second pack off 48. The outer or annulus pressure region 54 is external to or surrounding the liner 22. In the illustrated example, the inner pressure region 50 is separated from intermediate pressure region 52 by second pack off 48 which may comprise a two-way seal. The first pack off 46 is positioned to separate intermediate pressure region 52 from the annulus pressure region 54. However, the first pack off 46 may comprise a one-way seal which allows pressure equalization flow from annulus pressure region 54 to intermediate pressure region 52 while blocking pressure/fluid flow from intermediate pressure region 52 to annulus pressure region 54. The first pack off 46 and the second pack off 48 are thus designed to enable pressure to build within the intermediate pressure region 52 between the pack offs 46, 48.

The liner 22 may have a variety of sizes, lengths, constructions, and/or components depending on the specifics of a given application. Additionally, the liner 22 may be used in cooperation with many types of components suited for a given application. For example, a liner top packer 56 may be employed between a liner tubing 58 and an interior of casing 30 to form a seal. The packer 56 may include a setting sleeve or other packer actuation mechanism. Examples of other components comprise a landing collar 60 and float equipment 62 which may be positioned along an interior of liner tubing 58 at a downhole end of the liner 22. Other components may be added and/or substituted to accommodate specific applications.

Figure 2:
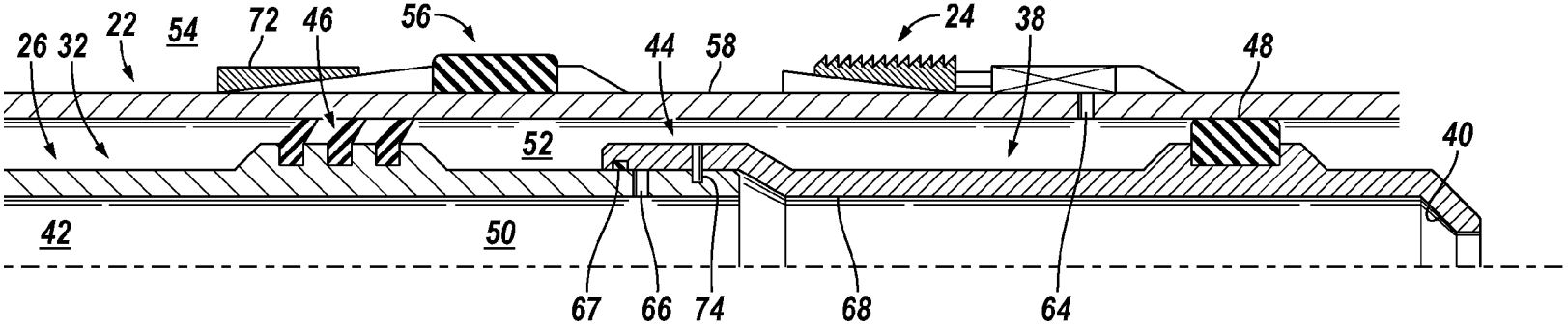
FIG. 2 is a cross-sectional view of an example of a portion of the running string, liner, and liner hanger, according to an embodiment of the disclosure.

Referring generally to FIG. 2, an embodiment of running string 26 deployed in liner 22 and its liner hanger 24 is illustrated. In this example, liner hanger 24 comprises a hydraulically actuated liner hanger which may be selectively actuated against the interior surface of casing 30 via pressurized hydraulic fluid. The pressurized hydraulic fluid may be introduced to the liner hanger 24 via a liner hanger port 64 disposed within liner hanger 24. In this example, the liner hanger port 64 may comprise a single port or a plurality of ports located between the first pack off 46 and the second pack off 48, as illustrated.

By way of example, the first pack off 46 may be an uphole pack off which functions as a one-way seal to allow pressure transfer from outer pressure region 54 to intermediate pressure region 52 while preventing pressure transfer from intermediate pressure region 52 to the outer pressure region 54. The one-way seal may be formed by a swab cup or other one-way pressure holding device suitable for the pressures and pressure differentials of a given application. The second pack off 46 may be a downhole pack off which functions as a two-way seal to prevent pressure transfer in either direction across the seal.

In the example illustrated, the closure mechanism 44 is used to selectively close and/or open a running string port 66 extending through a wall of the running string 26. For example, the running string port 66 may comprise a single port or a plurality of ports located between the first pack off 46 and the second pack off 48 for selective communication between the inner pressure region 50 and the intermediate pressure region 52. Initially, the running string port 66 may be closed by closure mechanism 44 to prevent fluid flow and pressure transfer during, for example, running of the liner 22 downhole. By closing the running string port 66, inner pressure region 50 is isolated with respect to liner hanger 24 via a seal 67 in closure mechanism 44, thus avoiding premature actuation of the liner hanger 24.

Figure 3:
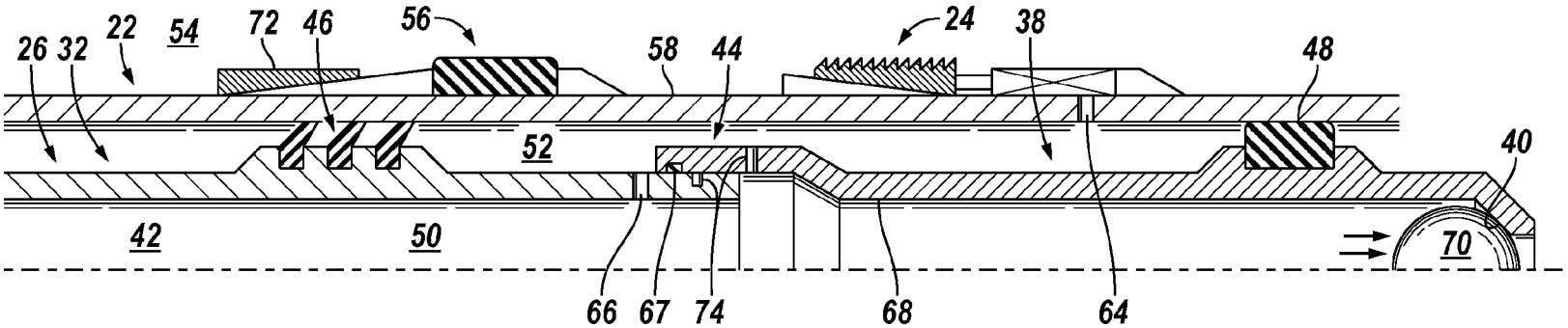
FIG. 3 is a cross-sectional view similar to that of FIG. 2 but showing the running string in a different operational position, according to an embodiment of the disclosure.

In some applications, closure mechanism 44 comprises a sliding sleeve joint 68. In the embodiment illustrated, the sliding sleeve joint 68 is actuated to open port 66 by dropping an object 70 along interior 42 and into sealing engagement with seat 40, as illustrated in FIG. 3. By way of example, object 70 may comprise a ball sized for sealing engagement with a corresponding ball seat 40. Once object 70 is positioned against seat 40, the pressure in inner pressure region 50 may be increased by pumping fluid into interior 42 until the sliding sleeve joint 68 is shifted to open running string port 66, as further illustrated in FIG. 3. Prior to opening running string port 66, however, the intermediate pressure region 52 is protected from any pressure increases that might occur along inner pressure region 50. In other words, inner pressure region 50 is isolated from intermediate pressure region 52 prior to the desired actuation of liner hanger 24.

By opening running string port 66, pressurized fluid may be directed from inner pressure region 50 into intermediate pressure region 52. The higher pressure fluid in intermediate pressure region 52 then moves through liner hanger port 64 for actuation of liner hanger 24. Actuation of liner hanger 24 causes expansion of the liner hanger into engagement with the surrounding casing 30, as illustrated in FIG. 1. Pressurized fluid supplied via interior 42 may be used to set packer 56 via, for example, a setting sleeve 72. In some embodiments, packer 56 may be set by slacking off weight.

A variety of closure mechanisms 44 may be used to selectively close and open port 66. If the closure mechanism 44 is constructed as sliding sleeve joint 68, the sliding sleeve joint 68 may be designed to open at a predetermined value. The predetermined value may be established by a shear member 74 or similar device. In this example, member 74 is designed to establish a predetermined pressurization of inner pressure region 50 which is sufficient to shear the member 74 and to shift the sliding sleeve joint 68, thus opening port 66 as illustrated in FIGS. 2 and 3. In some applications, sliding sleeve joint 68 also may be biased to a desired position, e.g. an open position, or otherwise controlled/biased to facilitate actuation of port 66.

In an operational example using the embodiment illustrated in FIGS. 2 and 3, the running string 26 is used to deliver the liner 22 and liner hanger 24 to a target depth within wellbore 28. The object 70, e.g. ball, is then dropped from the surface and delivered downhole to the seat 40. Once the object 70 is seated against seat 40, pressure is increased within inner pressure region 50 to open the sliding sleeve joint 68. The pressure is increased to a sufficient level to also set the liner hanger 24 via pressure transfer through running string port 66 and liner hanger port 64.

After setting the liner hanger 24, the running tool 32 of running string 26 is released by releasing coupling mechanism 34 via a tensile load, a pressure actuation, or another suitable release technique. The pressure may then be further increased within inner pressure region 50 to shear ball seat 40 at shear region 76. Once the ball seat 40 is sheared, the pressure in pressure region 50 drops and sliding sleeve joint 68 may be closed or it may be held open by a suitable lock mechanism. (Sliding sleeve joint 68 may be transitioned to the closed position by a spring member, set down weight, or other suitable mechanism.) At this stage, circulation can be established for a given operation. For example, on achieving stabilized circulation cement can be pumped to perform a cementing operation and the liner top packer 56 may be tested. However, additional or other operations also may be performed via the running string 26 or other suitable equipment.

The system and methodology described herein are able to protect a hydraulic liner hanger 24 from premature actuation even if the interior of the running string is exposed to pressure surges. A ball seat or other type of pressure building device may be connected to or formed as part of the running tool 32 to provide pressure isolation between the running string 26 and the liner 22. If the running string 26 is deployed downhole without object/ball 70, the second pack off 48 (in combination with the closure mechanism 44) ensures that pressure surges do not reach the liner hanger 24. The first or uphole pack off 46, however, enables pressure equalization from the outer pressure region 54 to the intermediate pressure region 52 inside the hydraulic liner hanger 24 in a variety of situations, including "bridging" or "pressure isolation" situations occurring in the annulus.

In some applications, the running string 26 may be picked up to check for release of the running tool 32 following removal of the seat 40. The system may be designed so that picking up the running string 26 releases the closure mechanism 44 in a manner which opens port 66. Port 66 is opened to allow the ingress of fluid from interior 42 of the running string 26 to the intermediate region 52 between the first and second pack offs 46, 48. When the running string 26 is lowered back to start a cementation process or other service operation, the closure mechanism 44 is again moved to the closed position after having allowed a flow of fluid from the intermediate region 52 into the interior 42 of running string 26. During the cementation process or other suitable process, the closure mechanism 44, e.g. sliding sleeve joint 68, may remain in a closed position which exposes the downhole pack off 48 to displacement pressure. Similarly, the closure mechanism 44 may remain in a closed position during testing of the packer 56 as the downhole pack off 48 is similarly exposed to the test pressure. In some applications, the closure mechanism 44 is actuated to open port 66 during retrieval of the running string 26. The port 66 may be opened by lifting the running string 26 or by another suitable actuation technique.

The selective actuation of closure mechanism 44, liner hanger 24, and/or liner packer 56 may vary from one application to another. For example, the running string port 66 may be selectively opened and closed by closure mechanism 44 at different stages depending on the type of cementation application or other application for which the running string may be employed in addition to delivering liner 22 to the desired downhole location. Various packers and/or other mechanisms also may be hydraulically actuated at specific stages of an operation via selective opening of port 66.

It should be further noted that running string 26 and/or liner 22 may be constructed in a variety of configurations with many types of components depending on a given downhole application. The system and methodology may be employed in vertical and/or deviated, e.g. horizontal, wellbores. Additionally, the configuration of the liner hanger, closure mechanism, seat, shear mechanisms, pack offs and/or other components of the overall system may be adjusted to accommodate structural, environmental, and/or operational parameters.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for avoiding premature actuation in a wellbore, comprising:

a liner having a liner hanger; and a running string coupled to the liner and extending into the liner in a manner which creates an inner pressure region within the running string, an intermediate pressure region between the running string and the liner, and an annulus pressure region surrounding the liner, the intermediate pressure region and the annulus pressure region being pressure balanced via a one-way seal during movement downhole into the wellbore if pressure in the annulus pressure region exceeds pressure in the intermediate pressure region, the inner pressure region being selectively isolated from the intermediate pressure region by a closure mechanism closing a port until desired actuation of the liner hanger.

2. The system as recited in claim 1, wherein the closure mechanism comprises a sliding sleeve joint.

3. The system as recited in claim 2, wherein the running string comprises a ball seat for receiving a ball to enable increased pressure in the inner pressure region for actuating the sliding sleeve joint.

4. The system as recited in claim 1, further comprising a first pack off and a second pack off disposed between the running tool and the liner.

5. The system as recited in claim 4, wherein the first pack off is positioned uphole relative to the closure mechanism and the second pack off is positioned downhole relative to the closure mechanism.

6. The system as recited in claim 5, wherein the first pack off forms the one-way seal and the second pack off forms a two-way seal to ensure against a hydraulic lock between the first pack off and the second pack off.

7. The system as recited in claim 6, wherein the liner hanger is actuated hydraulically through a port located between the first pack off and the second pack off.

8. The system as recited in claim 1, further comprising a packer disposed around the liner.

9. The system as recited in claim 8, further comprising a casing, wherein the packer is selectively settable against the casing.

10. A method, comprising:

coupling a running string to a liner having a liner hanger;

providing a liner hanger port through a wall of the liner hanger and a running string port through a wall of the running string to enable actuation of the liner hanger via pressurized fluid supplied through the running string port and the liner hanger port;

closing the running string port initially as the running string and the liner are run downhole into a wellbore;

selectively opening the running string port to actuate the liner hanger via pressurized fluid supplied along an interior of the running string;

placing a first pack off and a second pack off between the running string and the liner at positions on opposite sides of both the running string port and the liner hanger port; and forming the first pack off as a one-way seal and the second pack off as a two-way seal.

11. The method as recited in claim 10, wherein closing comprises closing the running string port with a sliding sleeve joint.

12. The method as recited in claim 11, wherein selectively opening comprises sealing off an interior of the running string with an object dropped against a seat downhole of the sliding sleeve joint and increasing pressure within the interior to shift the sliding sleeve joint and to thus open the running string port.

13. The method as recited in claim 10, further comprising positioning a packer and a setting sleeve along an exterior of the liner.

14. The method as recited in claim 13, further comprising setting the packer against a surrounding casing.

15. A method, comprising:

coupling a running string to a liner having a liner hanger to create an inner pressure region within the running string; an intermediate pressure region between the running string and the liner and bounded by a first pack off and a second pack off; and an outer pressure region along an exterior of the liner;

isolating the inner pressure region from the intermediate pressure region and the outer pressure region as the running string and liner are deployed downhole through a wellbore casing;

selectively opening a port through a wall of the running string to enable communication of a flow of pressurized fluid from the interior pressure region to the intermediate pressure region;

using the pressurized fluid in the intermediate pressure region to actuate the liner hanger against the wellbore casing;

equalizing pressure between the outer pressure region and the intermediate pressure region via a one way seal when pressure in the outer pressure region rises above pressure in the intermediate region as the liner is moved downhole through the wellbore casing.

16. The method as recited in claim 15, wherein selectively opening comprises shifting a sliding sleeve joint.

17. The method as recited in claim 15, further comprising setting a packer against the wellbore casing uphole from the liner hanger.

* * * * *